United States Patent [19]

Knabel et al.

[11] Patent Number: 4,624,473

[45] Date of Patent: Nov. 25, 1986

[54] HEEL BINDING

[75] Inventors: Walter Knabel, Murnau; Josef Hafner, Grobenzell; Martin Scheer, Munich, all of Fed. Rep. of Germany

[73] Assignee: Marker International Company, Salt Lake City, Utah

[21] Appl. No.: 678,562

[22] PCT Filed: Mar. 30, 1984

[86] PCT No.: PCT/EP84/00091

§ 371 Date: Nov. 30, 1984

§ 102(e) Date: Nov. 30, 1984

[87] PCT Pub. No.: WO84/03841

PCT Pub. Date: Oct. 11, 1984

[30] Foreign Application Priority Data

Mar. 31, 1983 [DE] Fed. Rep. of Germany ..... 3311901

[51] Int. Cl.[4] ..... A63C 9/08

[52] U.S. Cl. ..... 280/612; 280/626; 280/632; 280/634

[58] Field of Search ..... 280/612, 628, 632, 634, 280/611, 626, 631

[56] References Cited

U.S. PATENT DOCUMENTS

| | | | |
|---|---|---|---|
| 4,089,541 | 5/1978 | Marata | 280/631 |
| 4,444,413 | 4/1984 | Richert et al. | 280/634 |
| 4,494,767 | 1/1985 | Campillo et al. | 280/612 |

FOREIGN PATENT DOCUMENTS

| | | | |
|---|---|---|---|
| 3200406 | 8/1982 | Fed. Rep. of Germany | 280/634 |

*Primary Examiner*—John J. Love
*Assistant Examiner*—Richard Camby
*Attorney, Agent, or Firm*—D. Peter Hochberg

[57] ABSTRACT

A safety ski binding having a release member actuable in response to forces or moments exceeding a threshold value, a carriage biased forwardly by a carriage spring, a sole holder mounted on the carriage and biased to an open position, a locking lever mounted on the carriage for releasably locking the sole holder in the open position, a locking lever spring biasing the locking lever to the position for opening the sole holder and for biasing the carriage rearwardly, a locking pawl for controlling the condition of the locking lever, and a connecting mechanism responsive to actuation of the release member for actuating the locking pawl to effect rearward movement of the carriage under the influence of the locking lever spring without overcoming the force of the carriage spring.

14 Claims, 4 Drawing Figures

HEEL BINDING

BACKGROUND OF THE INVENTION

This invention relates to safety ski bindings, and in particular to bindings capable of releasing a ski boot secured in the binding in response to both vertical forces and to transverse forces and moments.

There are many ski bindings known in the art for securing a skier's boot to the ski on which the binding is mounted, and for releasing the boot when forces or moments of predetermined values are detected. There has been a continuing effort to devise such bindings which are effective in operation, which are rugged enough to withstand the environment in which they are used, and which are economical to manufacture. Many known bindings are complex assemblies of parts which are vulnerable to malfunction. Other bindings are effective with regard to one type of force such as vertical forces (relative to the plane of the ski), but are less effective with regard to other forces and moments, such as those applied transversely in the plane of the ski Thus, bindings are known having a heel piece which rotates about a horizontal axis perpendicular to the longitudinal axis of the ski on which the binding is mounted from a lower, locked position to a raised open position in response to high vertical forces, the heel piece being mounted on a forwardly biassed carriage to provide the binding with a step-in capability which automatically cocks the binding when a boot is placed therein. This forward bias can limit the effectiveness of the binding in response to transverse forces or moments, since the forward bias is normally strong and difficult to overcome.

The foregoing problems are also present in electronic ski bindings which have been disclosed in the art. Electronic bindings generate electrical signals corresponding to sensed forces and moments, and these signals are processed and used to effect energization or deenergization of coils and the like when they exceed predetermined threshold values, to cause the actuation of a release member such as a solenoid. The mechanical device for opening the binding warrants the same considerations discussed above.

Commonly assigned German patent application No. P 31 46 318.5 discloses another ski binding wherein both vertical and transverse forces are treated by the binding.

SUMMARY OF THE INVENTION

An object of the present invention is to provide an improved rugged and effective safety ski binding.

Another object of the invention is to provide a safety ski binding capable of simplified and economical construction.

A further object of the invention is to provide a safety ski binding which effectively releases a ski boot therefrom in response to forces and moments applied in both the vertical direction, and in the transverse direction in the plane of the ski.

Yet a further object is the provision of a binding of the foregoing type which uses a relatively small number of springs.

Another object of the invention is to provide a release mechanism having the preceding characteristics which can be employed in an electronic binding having an electronic control system.

A further object is to provide a safety ski binding having the foregoing characteristics which can be mounted on a ski in the conventional manner.

Other objects will be apparent from the description to follow and from the appended claims These objects are achieved according to the preferred embodiment of the invention by the provision of a ski binding having a carriage biased on a base plate in the forward direction by a strong spring, a rotatable soleholder for engaging the heel of a boot mounted on the carriage, a locking lever mounted on the carriage for releasably locking the sole holder in its closed position, a locking lever spring for both biasing the locking lever to its locking position and for biasing the carriage rearwardly, a locking pawl for controlling the condition of the locking lever, a release member for effecting release of the binding, and a connecting mechanism interconnecting the release member and the locking pawl. In response to the foregoing transverse forces and moments whose value exceeds a threshold value, the release member actuates the locking pawl to change the locking lever to an unlocking condition, whereupon the locking lever spring moves the carriage rearwardly without overcoming the force of the carriage spring, and the sole holder also rotates to its open position.

DETAILED DESCRIPTION OF THE PREFERRED EMBODIMENT

Figure 1:
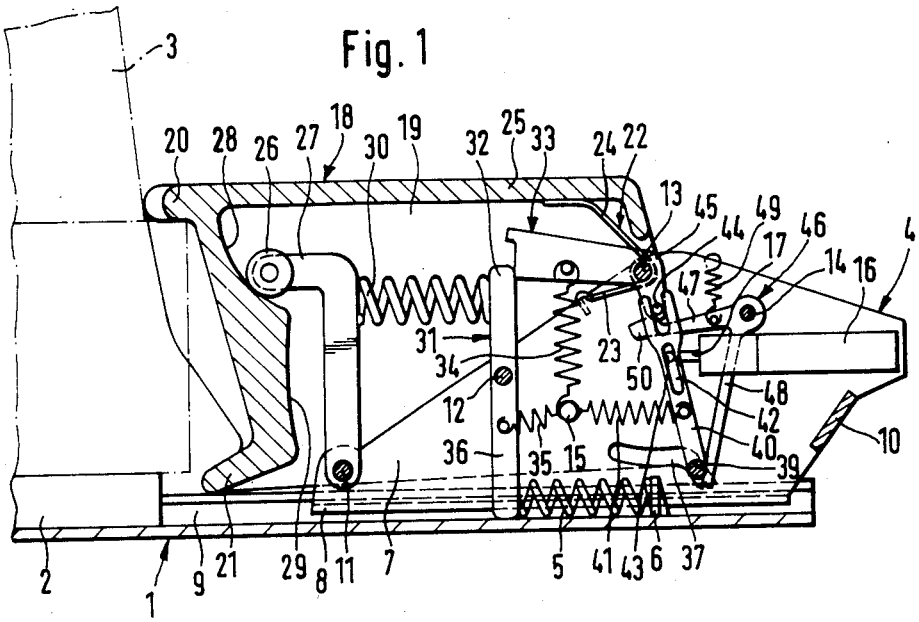
FIG. 1 shows a sectional elevation of the heel assembly of a safety ski binding in the skiing position with a boot secured therein.

Referring to the drawings, the heel piece of a safety ski binding is illustrated since the components of the preferred embodiment are all located in the heel piece. As in the case of known, conventional heel assemblies, the present one is provided with a base plate 1 by means of which the heel assembly is mounted onto a ski (not illustrated). A sole plate 2 rests stationary with respect to the base plate and supports the back end of a ski boot 3 sketched in dotted lines. A sliding carriage 4 is positioned for movement in the longitudinal direction of the ski on base plate 1 such that movement is toward the rear end of the ski, i.e., in the right-hand direction of the drawing, against the force of a pressure spring or carriage spring 5. A plate 6 on the base plate provides the stop for the pressure spring. As is known and therefore not separately illustrated, the stop on the base plate can be moved lengthwise of the plate so that the pressure can be varied and the binding adapted to shoe soles of different lengths.

The sliding carriage 4 comprises two sidewalls in mirror symmetry, only one of which being illustrated, namely sidewall 7 located behind the plane of the diagram. The bottom rim 8 of each sidewall is bent in the outward direction and forms a ribbed guide engaging groove 9 of base plate 1. Both the sidewalls of the carriage 4 are solidly connected to each other by means of a cross piece 10 as well as the five spacer bolts 11, 12, 13, 14, 15. The spacer bolts 11–14 also serve as axes of rotation for parts that are yet to be described, whereas spacer bolt 15 is additionally utilized to suspend springs that are yet to be described. The sidewalls of carriage 4 additionally support a housing 16 for locating an electromagnet that is either energized or deenergized when a specific threshold value is reached, whereupon its armature releases the locked binding in a manner that is yet to be described. Housing 16 suitably also contains a device for amplifying the impulses emanating from the electromagnet. Such a device that might be employed is the subject matter of prior German patent application No. P 31 32 465.7. A release member in the form of a ram 17 controlled directly or indirectly by the electromagnet projects from housing 16.

The axes of rotation 11–14 are located in carriage 4 parallel to each other and parallel to the base plate 1, but horizontal to the, lengthwise extension of base plate 1. A sole-holding member or sole holder 18 is positioned by means of its sidewalls on the axis of rotation 13, of which sidewalls only one is illustrated in the sectional drawing and is designated 19. The hold-down part of the sole-holding member, which part grips the back rim of a sole of a ski boot, is designated 20. A locking pedal 21 forms an integral part of sole-holding member 18. The sole-holding member is controlled by sole holder biasing means in the form of an opening spring, constructed in the present case as helical torsion spring 22 positioned on the axis of rotation 13. A leg 23 of the spring braces against sidewall 7 of carriage 4 and another leg 24 braces against a top wall 25 of the sole-holding member 18.

A roller 26 serves to hold down the sole-holding member 18 in its closed position, roller 26 being rotatably mounted on the bent end of a lever 27 positioned on the axis of rotation 11 in the carriage 4. The sole-holding member has two curved sections 28 and 29 for the purpose of cooperating with the roller. Lever 27 is controlled by a lever biasing means shown as a compression spring 30 braced against a lever 31 using spacer bolt 12 in carriage 4 as its axis of rotation. (Spring 30 controls the upward elasticity of the sole holder, and is preferably held in a spring cage under pre-tension so that it does not completely relax when the binding is opened). Lever 31 is constructed as elongated lever and remains at right angles to base plate 1 when the sole-holding member 18 is in a closed, as well as also in an open position. By means of its upper arm 32 against which the compression spring 30 presses, lever 31 normally braces against a locking pawl 33 positioned on the axis of rotation 13 in the coaxial direction to the sole-holding member 18. The locking pawl is controlled by a restoring spring 34 constructed as tension spring and suspended from spacer bolt 15 within the carriage 4. Also suspended from spacer bolt 15 is a tension spring 35 engaging the lower arm 36 of the lever 31. Pressure spring 5 also engages this arm but in opposite direction. The tension spring 35 merely functions as a restoring spring and is rendered ineffective when lever 31 is locked by locking pawl 33. Pressure spring 5 and the compression spring 30 engage lever 31 in the same direction of rotation.

A curved slot 37 is provided in each sidewall 7 of the carriage 4 in congruent positions, slot 37 forming a gate or guide, the right end 38 of which (see particularly FIG. 3) with reference to the illustrations, extends away from the center of curvature. A pin 39 is guided by these slots and protrudes through the sidewalls of the carriage at both ends into the pivoting region of the sidewalls 19 of the sole-holding member 18. A pivoting member 40 is solidly connected to the pin 39 between the sidewalls 7. Member 40 is engaged by a restoring spring 41 constructed as a tension spring, also suspended from spacer bolt 15. Pivoting member 40 has a slot 42 in its middle section, this slot being engaged by a lug 43 attached to or shaped as a part of the free end of ram 17. The upper end of the pivoting member 40 as illustrated is forked and provides a pivoting and sliding guide for a crankpin 44 located on a lever arm 45 of the locking pawl 33 constructed as a toggle lever Spacer bolt 14 serves as the axis of rotation for a clutch lever 46 constructed as lever having arms 47 and 48 Arm 47 is engaged by the tension spring 49 serving as a restoring spring and suspended from the sidewall 7 of carriage 4 The free end of the lever arm 47 has a projection 50 which with arm 47 defines a shoulder serving as a stop cam for the crankpin 44 of the locking pawl 33, and forms a support surface. The arm 48 of clutch lever 46 extends into the path of movement of pin 39 guided by the gate 37, and transmits the motion of pin 39 to clutch lever 46.

Figure 4:
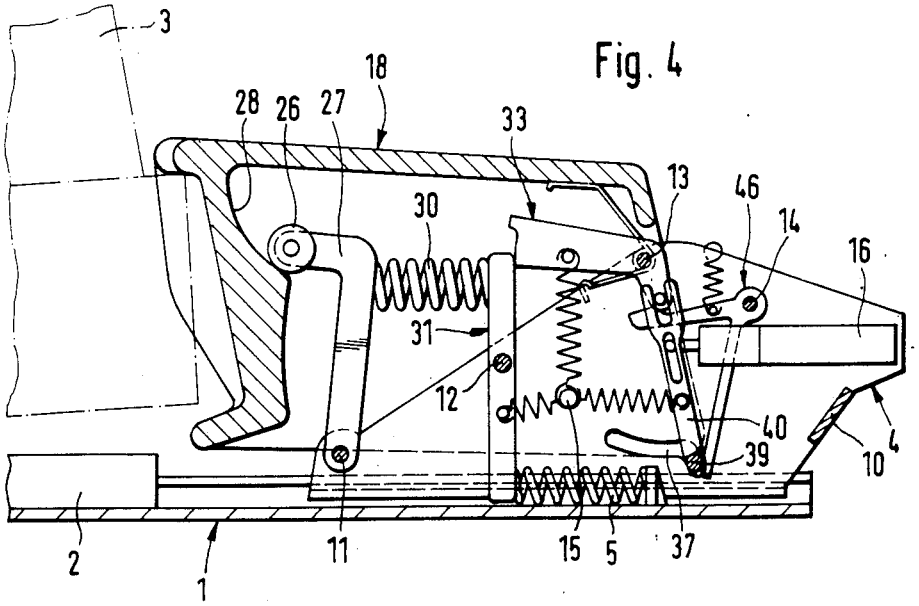
FIG. 4 shows the heel assembly of FIG. 1 prior to release of the binding, when the sole holder of the binding is under upwardly directed stress.

FIG. 1 shows the heel assembly in its operating or skiing condition, i.e., with ski boot 3 in place. The sole-holding member 18 is kept on the top rim of the sole of the ski boot under the tension of roller 26. Depending upon the thickness of the sole, the roller thereby acts on curved section 28 in a somewhat higher or somewhat lower position. The illustration shown corresponds to that provided approximately by the maximum thickness of a sole. Since even in this case a predetermined path on the curved section 28 is still available for roller 26, on the one hand the binding can still be closed even in the presence of a certain amount of snow beneath the heel of the ski boot, and on the other hand, greater skiing comfort is achieved by means of the elastic holding down of the back end of the sole. Forces directed upward and engaging the holding-down part 20 of the sole-holding member, which forces are caused, for example, by frontal or diagonal stress and that exceed the pretension of the compression spring 30, result in clockwise pivoting (see FIG. 4) of the sole-holding member 18 about the axis of rotation 13. As the force decreases, a return to the starting position illustrated in FIG. 1 is achieved. Since upon introducing the ski boot into the binding of the sole-holding member 18, the latter and therewith carriage 4 are moved toward the right with respect to the illustration provided, pressure spring 5 is correspondingly under tension.

Figure 2:
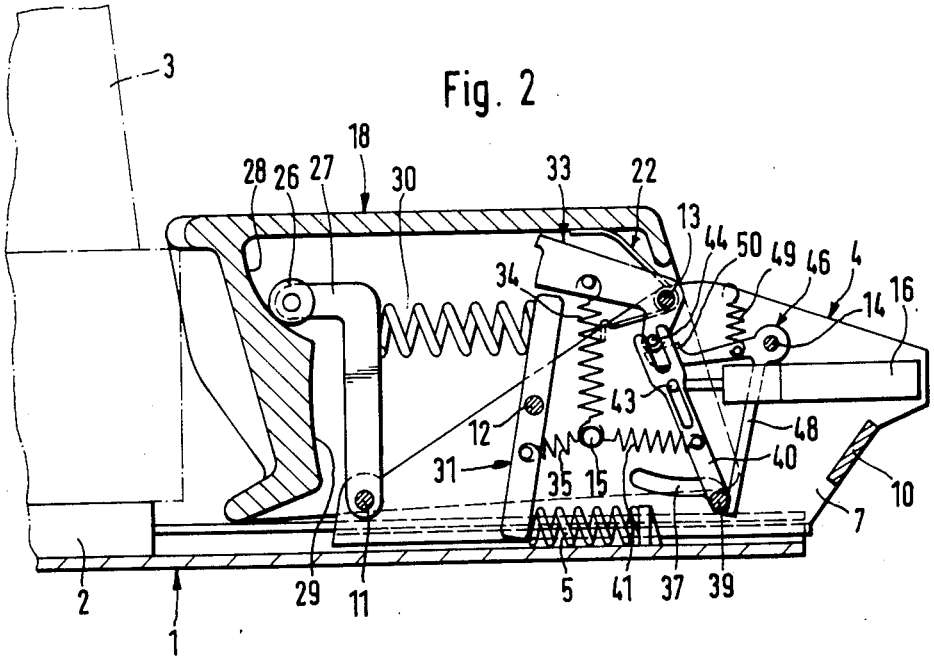
FIG. 2 depicts the heel assembly of FIG. 1 at the moment at which the boot is released subsequent to a lateral force or moment, i.e., a release occurring during a twisting fall.

FIG. 2 illustrates the heel assembly at the moment the boot is released in the event of lateral stress, i.e., for a twisting fall release. The value measured by the force sensing means has reached the threshold value, resulting in energizing or deenergizing (according to the nature of the circuitry) the electromagnet located in housing 16, thereby causing ram 17 to exit from the housing. This movement leads to pivoting of the pivoting member 40 for which pin 39 forms the center of rotation. The pivoting member engages and moves crankpin 44, thereby pivoting locking pawl 33 clockwise, and thus resulting in release of lever 31. This release results in movement of carriage 4 away from ski boot 3 toward the right as shown in the drawings (see FIGS. 1 and 2), such occurring without overcoming the force of pressure spring 5. This is the very moment illustrated in FIG. 2.

Subsequently, ski boot 3 is no longer held at all by sole-holding member 18, whereupon opening spring 22 relaxes and pivots the sole-holding member 18 upward. By pivoting lever 31 upon its release by locking pawl 33, compression spring 30 is relieved to such an extent that roller 26 can pass from curved section 28 on to curved section 29 without preventing upward movement of the sole-holding member 18 under the influence of opening spring 22. In order to allow the ski boot to be independently released in the lateral direction, it is necessary to apply only a slight force to move the carriage on base plate 1 away from the boot. It is only necessary to overcome the tension of tension spring 35 arranged between carriage 4 and the lever 31, the bottom end of which lever is held back by pressure spring 5 upon corresponding movement of the carriage.

Figure 3:
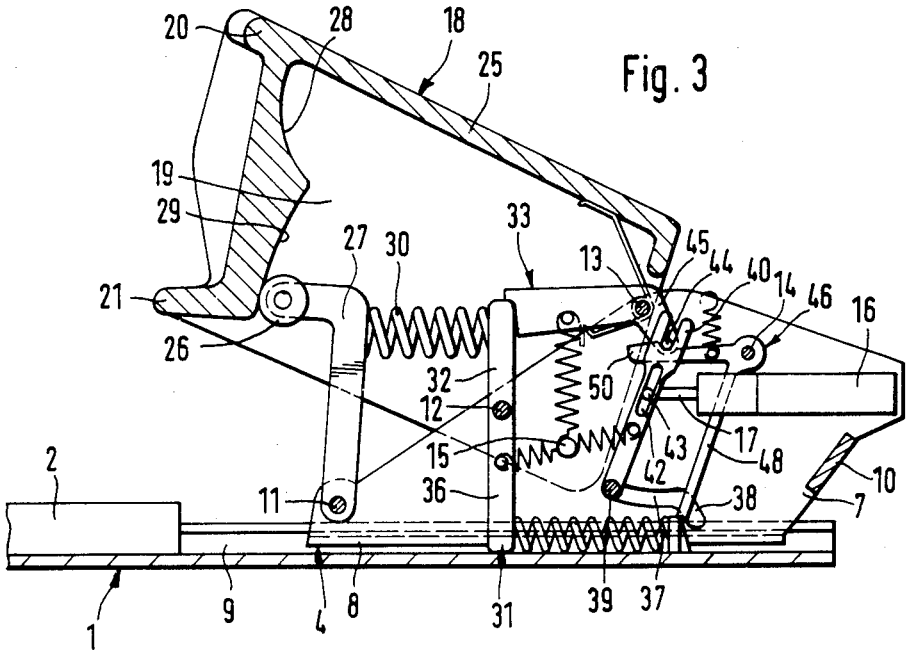
FIG. 3 shows the heel assembly of FIG. 1 in its open position.

The heel assembly automatically moves from its position illustrated in FIG. 2 into an open position corresponding to FIG. 3. The sole-holding member 18 is shown in its topmost limiting position. After complete release of the ski boot from the sole-holding member, carriage 4 moves into its foremost limiting position, such being achieved by releasing tensioning spring 35. This movement leads to a return pivoting movement of the lever 31, which in turn permits locking pawl 33 to assume the locking position illustrated in FIG. 3 under the influence of restoring spring 34. By pivoting crankpin 44 of locking pawl 33 on the one hand, and under the control of the restoring spring 41 on the other hand, pivoting member 40 passes from its position given in FIG. 2 into the one provided in FIG. 3. Once crankpin 44 has run the length of projection 50 of lever arm 47 of the clutch lever 46, it is possible for the lever to move into its locking position illustrated in FIG. 3, under the influence of tension spring 49.

In stepping into the binding, the heel or back end of the sole of a ski boot, comes in contact with the locking pedal 21 and pivots the sole-holding member in the illustration provided counterclockwise. This movement occurs against the force of the opening spring 22 and the compression spring 30, whereby the roller 26 transfers from the curved section 29 to the curved section 28. At the same time the sole-holding member is locked, carriage 4 is also moved counter to the force of the pressure spring 5. During the locking movement of the sole-holding member, that rim of sidewalls 19 positioned in front with respect to the direction of movement slips onto the free end of pin 39 of pivoting member 40 taking it along, whereby crankpin 44 of locking pawl 33 provides the fulcrum for the pivoting member 40. By pivoting the pivoting member, ram 17 is moved within housing 16, thereby tensioning the springs provided optionally for intensifying the impulse emanating from the electromagnet. Once pin 39 has advanced through the central part of slot 37, it is pushed into the part 38 by sidewalls 19 and kept there. During its last phase of movement, pin 39 steps onto lever arm 48 of clutch lever 46 and pivots the latter counter to the force of tension spring 49 such that the step formed at projection 50 releases crankpin 44 of locking pawl 33. The arrangement is such that ram 17 is pushed into housing 16 by means of pivoting member 40 by a small amount extending past its locking point. This enables projection of the ram by that amount during release of the crankpin 44 by clutch lever 46, thereby pivoting the locking pawl 33 across the pivoting member 40. This action thus provides the condition illustrated in FIG. 1.

In the event that ram 17 is not correspondingly spring-tensioned, it is necessary to provide such correspondingly strong tension to the restoring spring 41.

The safety ski binding described above has various advantageous features. Thus, one locking lever is used both for controlling the rotation of the sole holder to it open position as well as receiving the opening spring force to move the carriage rearwardly while circumventing the carriage spring. When appropriate forces are applied to the sole holder, both movements can be superimposed. Also, when the binding opens as a result of only lateral stress, it is subsequently in a condition to receive a ski boot for a subsequent ski run, as is true for release occurring from a forward fall or from an arbitrary (or manual) release. In the type of binding described above, arbitrary release can be provided by means for approximately changing the energy level of the electromagnet to activate the release mechanism.

The binding described above provides for limited upward movement of the sole-holding member prior to release of its locked position in known fashion against the force of a spring, and provides a stop for this spring in the same direction of rotation as the pressure spring on the lever. This obviates a need for adapting the sole-holding member to boot soles of different thicknesses, thereby providing at the same time the advantage that the binding can still be locked in the event of a certain amount of snow underneath the heel of the boot.

The locking lever 31 is advantageously constructed with two arms, whereby one of the two springs engages each arm. The lever is preferably an elongated lever placed in its normal position at least approximately vertical to the base plate. This permits compact construction particularly where the locking pawl cooperates with the arm of the lever against which that spring is braced which is responsible for the upward elasticity of the sole-holding member.

The invention has been described with reference to its preferred embodiment. Various modifications and additions which do not depart from the gist of the invention will be apparent to those of skill in the art. Accordingly, the scope of the invention is limited solely by the following claims.

We claim:

1. A safety ski binding attachable to a ski for releasably holding a ski boot on the ski, said binding having forward and rearward directions and comprising:

base plate means;

release means actuatable in response to the occurrence of forces or moments reaching a predetermined threshold value;

carriage means mounted on said base plate means for movement in the forward and rearward directions;

carriage spring means disposed between said base plate means and said carriage means for biasing said carriage means in the forward direction;

sole holder means mounted on said carriage means and movable between a closed position for engaging a ski boot to retain the boot in the binding, and an ppen position for releasing the ski boot from the binding;

sole holder biasing means for biasing said sole holder towards said open position;

pivot means attached to said carriage means;

locking means for releasably locking said sole holder means in the closed position, said locking means comprising lever means mounted on said pivot means, said lever means having a first condition for retaining said sole holder means in the closed position and a second condition for enabling said sole holder means to move to the open position, lever biasing means disposed between said sole holder means and said lever means, and biasing said lever means to the second condition and said sole holder means towards the closed position, locking pawl means having a locking position for holding said lever means in the first condition and an unlocking position for releasing said lever means to assume the second condition; and restoring means for urging said lever means to the first condition; and connecting means interconnecting said release means and said locking pawl means, said connecting means moving said locking pawl means from thellocking position to the unlocking position in repponse to the actuation of said release means, to transfer said locking means to the second condition and disable said carriage spring means from opposing movement of said carriage means in the rearward direction.

2. The invention according to claim 12 and further comprising lever biasing means disposed between said sole holder means and said lever means for biasing said lever means to the second condition and for biasing said sole holder means towards the closed position.

3. The invention according to claim 1 wherein said carriage spring means biases said lever means to the second condition.

4. The invention according to claim 1 wherein said lever means includes first and second arms on opposite sides of said pivot means, and wherein said carriage spring means engages said second arm and said lever biasing means engages said first arm to bias said lever means in the same direction.

5. The invention according to claim 4 wherein said lever biasing means urges said sole holder means to the closed position and provides said sole holder with elasticity in response to forces applied to the sole holder towards the open position.

6. The invention according to claim 1 wherein said lever means is an elongated lever extending generally perpendicular to said base plate means when in the first condition.

7. The invention according to claim 1 wherein said connecting means further comprises:

pivoting means movably mounted on said carriage for movement between a retaining position retaining said locking pawl means in the locking position and a releasing position releasing said locking pawl means to the unlocking position, said pivoting means being operatively connected to said release means and to said locking pawl means;

second restoring means biasing said pivoting means to the first position; and clutch means movably mounted on said carriage means, said clutch means including stop means for blocking movement of said locking pawl means, and wherein said carriage means includes guide means for guiding the movement of said pivoting means between the retaining position and the releasing position;

said release means moving said pivoting means to said releasing position upon actuation of said release means, to effect movement of said locking pawl means to the unlocking position to release said lever means to the second condition to enable movement of said sole holder to the open position.

8. The invention according to claim 7 wherein said guide means comprises a slot in said carriage, said pivoting means includes pin means extending into said slot, said slot including a first section for receiving said pin when said pivoting means is in the retaining position and a second section for receiving said pin means when said pivoting means is out of the retaining position, and said clutch means includes carrier means for engagement by said pin means to move said locking pawl means out of the locking position during resetting of the pivoting means from the releasing position to the retaining position.

9. The invention according to claim 1 wherein said locking pawl means and said sole holder are pivotably mounted for rotation about a common axis.

10. The invention according to claim 1 and further including restoring spring means for biasing said locking pawl means towards the locking position.

11. The invention according to claim 1 wherein said release means is an electrical release means which is actuable in response to electromagnetic signals generated when the forces or moments reach the predetermined threshold value.

12. A safety ski binding attachable to a ski for releasably holding a ski boot on the ski, said binding having forward and rearward directions and comprising:

base plate means;

release means actuable in response to the occurrence of forces or moments reaching a predetermined threshold value;

carriage means mounted on said base plate means for movement in the forward and rearward directions;

carriage spring means disposed between said base plate means and said carriage means for biasing said carriage means in the forward direction;

sole holder means mounted on said carriage means and movable between a closed position for engaging a ski boot to retain the boot in the binding, and an open position for releasing the ski boot from the binding;

sole holder biasing means for biasing said sole holder towards said open position;

pivot means attached to said carriage means;

locking means for releasbly locking said sole holder means in the closed position, said locking means comprising lever means mounted on said pivot means, said lever means having a first condition for retaining said sole holder means in the closed position and a second condition for enabling said sole holder means to move to the open position, locking pawl means having a locking position for holding said lever means in the first condition and an unlocking position for releasing said lever means to assume the second condition; and restoring means for urging said lever means to the first condition; and connecting means interconnecting said release means and said locking pawl means, said connecting means moving said locking pawl means from the locking position to the unlocking position in response to the actuation of said release means, to transfer said locking means to the second condition and disable said carriage spring means from opposing movement of said carriage means in the rearward direction.

13. A safety ski binding attachable to a ski for releasably holding a ski boot on the ski, said binding having forward and rearward directions and comprising:

base plate means;

release means actuable in response to the occurrence of forces or moments reaching a predetermined threshold value;

carriage means mounted on said base plate means for movement in the forward and rearward directions;

carriage spring means disposed between said base plate means and said carriage means for biasing said carriage means in the forward direction;

sole holder means mounted on said carriage means and movable between a closed position for engaging a ski boot to retain the boot in the binding, and an open position for releasing the skitboot from the binding;

sole holder biasing means for biasing said sole holder means towards said open position;

pivot means attached to said carriage means;

locking means having a locking condition for releasably locking said sole holder means in the closed position, and an unlocking condition releasing said sole holder for movement to the open position.

connecting means interconnecting said release means and said locking means, said connecting means moving said locking means from the locking position to the unlocking position in response to the actuation of said release means, said connecting means further comprises:

pivoting means movable mounted on said carriage for movement between a retaining position retaining said locking means to the unlocking condition, said pivoting means being operatively connected to said release means and to said locking means;

restoring means biasing said pivoting means to the retaining position; and clutch means movably mounted on said carriage means, said clutch means including stop means for blocking movement of said locking means, said release means moving said pivoting means to said releasing position upon actuation of said release means, to effect movement of said locking means to the unlocking position to enable movement of said sole holder to the open position, and said locking means moving to the locking position in response to movement of said sole holder to the open position and the stop means of said clutch means releasably blocking said looking means from the locking condition.

14. The invention according to claim 13 comprising a guide means for guiding the movement of said pivoting means, said guide means comprises a slot in said carriage, said pivoting means includes pin means extending into said slot, said slot including a first and a second section, and said clutch means includes carrier means for engagement by said pin means to move said stop means out of the locking position during resetting of the pivoting means from the releasing position to the retaining position.

* * * * *